US010485324B2

(12) United States Patent
Kim

(10) Patent No.: US 10,485,324 B2
(45) Date of Patent: Nov. 26, 2019

(54) STICK TYPE COSMETIC CASE HAVING SCREW STRUCTURE

(71) Applicant: Jin Woo Kim, Anyang-si (KR)

(72) Inventor: Jin Woo Kim, Anyang-si (KR)

(73) Assignee: CTK CO., LTD, Seongnam-si, Gyeonggi-Do (KR)

( * ) Notice: Subject to any disclaimer, the term of this patent is extended or adjusted under 35 U.S.C. 154(b) by 0 days.

(21) Appl. No.: 16/072,435

(22) PCT Filed: Feb. 24, 2017

(86) PCT No.: PCT/KR2017/002101
§ 371 (c)(1),
(2) Date: Jul. 24, 2018

(87) PCT Pub. No.: WO2017/171245
PCT Pub. Date: Oct. 5, 2017

(65) Prior Publication Data

US 2019/0029399 A1 Jan. 31, 2019

(30) Foreign Application Priority Data

Mar. 30, 2016 (KR) ..... 10-2016-0038153
May 3, 2016 (KR) ..... 10-2016-0054381

(51) Int. Cl.
*A45D 40/06* (2006.01)
*B65D 53/02* (2006.01)
(Continued)

(52) U.S. Cl.
CPC ..... *A45D 40/06* (2013.01); *A45D 40/04* (2013.01); *B65D 83/0011* (2013.01); *B65D 83/0027* (2013.01); *A45D 2040/0025* (2013.01)

(58) Field of Classification Search
CPC ..... A45D 40/00; A45D 40/02; A45D 40/04; A45D 40/06; A45D 40/12; A45D 40/20;
(Continued)

(56) References Cited

U.S. PATENT DOCUMENTS 5,076,720 A * 12/1991 Roger ..... A45D 40/16 401/75
6,142,691 A * 11/2000 Crosta ..... A45D 40/04 401/68

(Continued)

FOREIGN PATENT DOCUMENTS

KR 20-0377681 Y1 3/2005
KR 10-1168375 B1 7/2012

(Continued)

*Primary Examiner* — David J Walczak
(74) *Attorney, Agent, or Firm* — John K. Park; Park Law Firm

(57) ABSTRACT

A stick type cosmetic case for moving makeup up/down in use. The case include: a bottom body (10) having a thread (11) formed around the outer side of an upper portion and an insertion tube (15) vertically formed therein; a middle body (20) rotatably inserted in an upper portion of the bottom body (10); a holder (30) having a screw tube (31), which has a lower portion inserted in an insertion tube (15) in the bottom body (10) and a threaded portion (31*b*) on an outer side to be spirally coupled to the spiral portion (22) of the middle body, and a holding tube (33) having a holding groove (33*a*) at an upper portion to insert stick type makeup (35) therein; and a top cap (40) thread-fastened to the thread (11) of the bottom body (10) to be opened and closed.

12 Claims, 9 Drawing Sheets

(51) Int. Cl.
*B65D 83/00* (2006.01)
*A45D 40/04* (2006.01)
*A45D 40/00* (2006.01)

(58) Field of Classification Search
CPC .... A45D 2040/0025; A45D 2040/0062; B65D 83/0027; B65D 83/0011; B65D 83/0022; B65D 83/0033
See application file for complete search history.

(56) References Cited

U.S. PATENT DOCUMENTS 6,957,753 B2 * 10/2005 Tani ..... A45D 34/042 222/390
8,172,472 B2 * 5/2012 Tani ..... A45D 40/04 222/390

FOREIGN PATENT DOCUMENTS

KR 10-2014-0125582 A 10/2014
KR 20-0476705 Y1 4/2015
KR 10-1532539 B1 7/2015
KR 10-1643119 B1 7/2016

* cited by examiner

[Fig. 1]
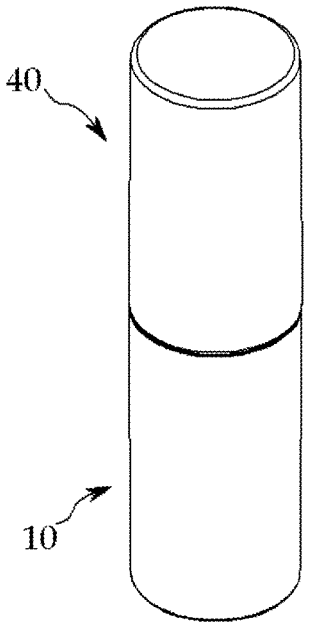
[Fig. 2]
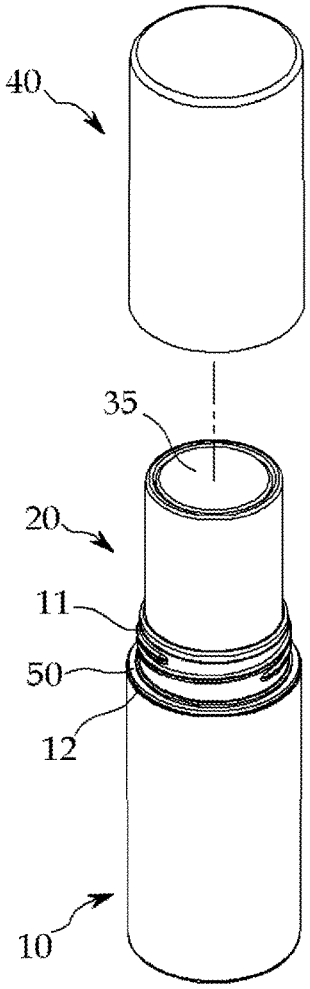

[Fig. 3]
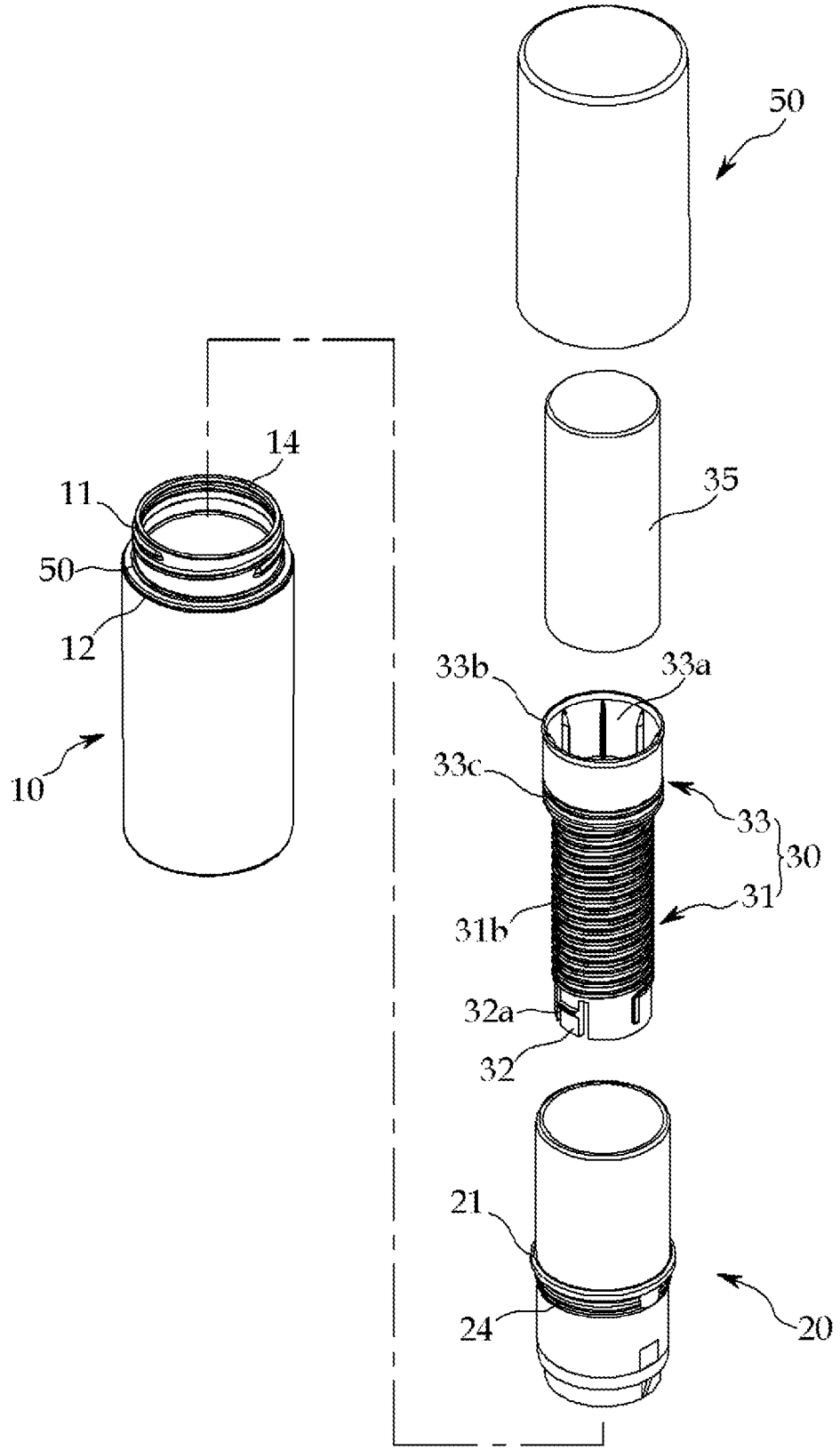

[Fig. 4]
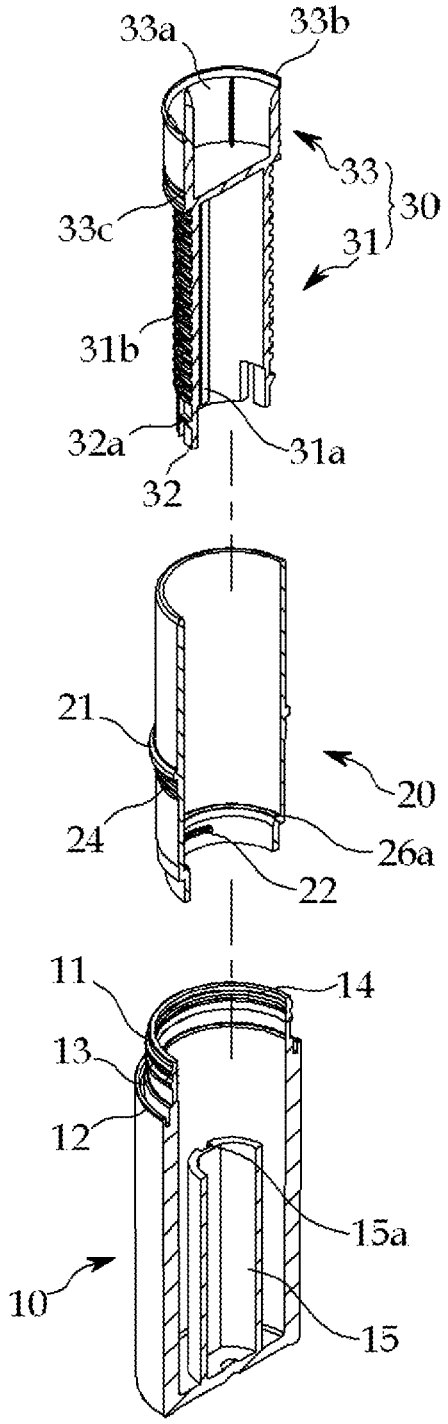

[Fig. 5]
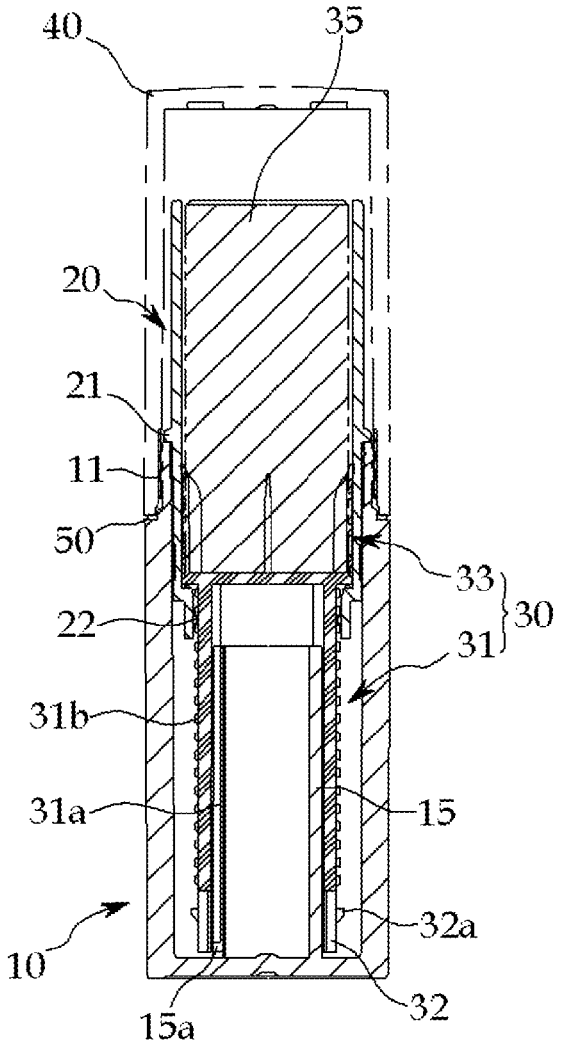
[Fig. 6]
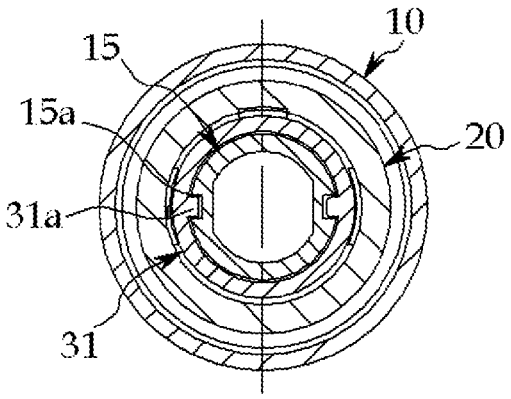

[Fig. 7]
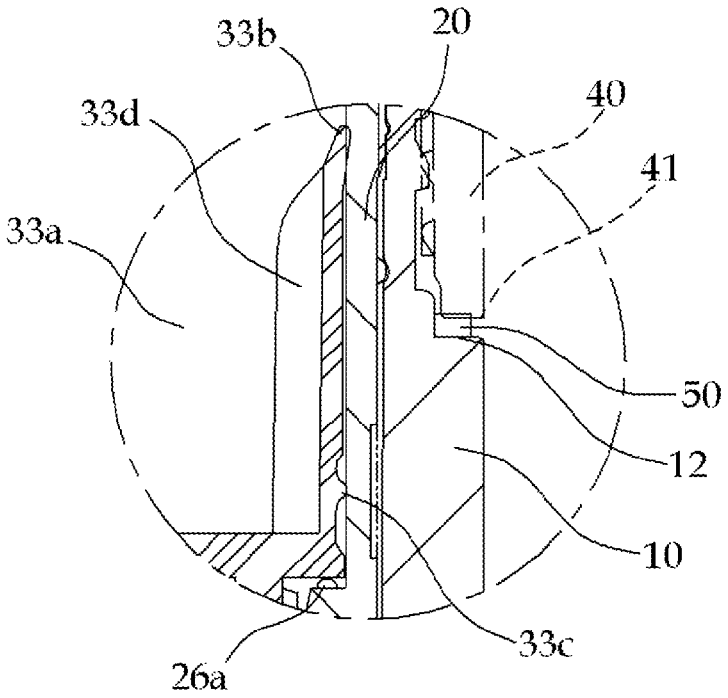
[Fig. 8]
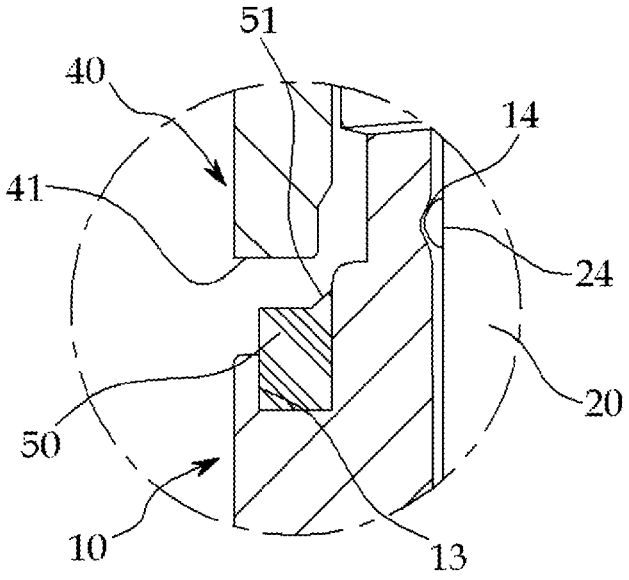

[Fig. 9]
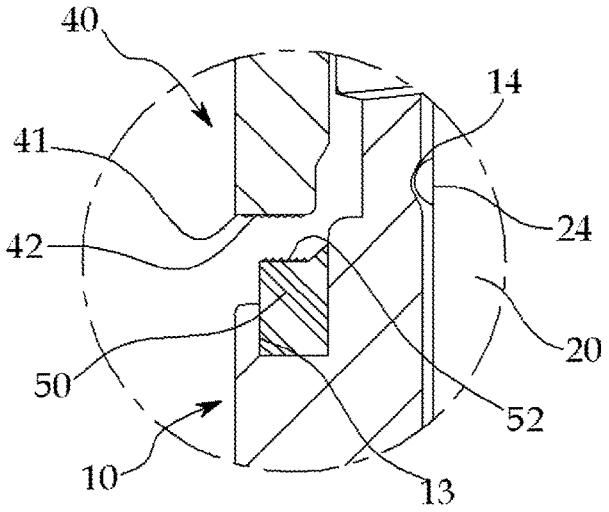
[Fig. 10]
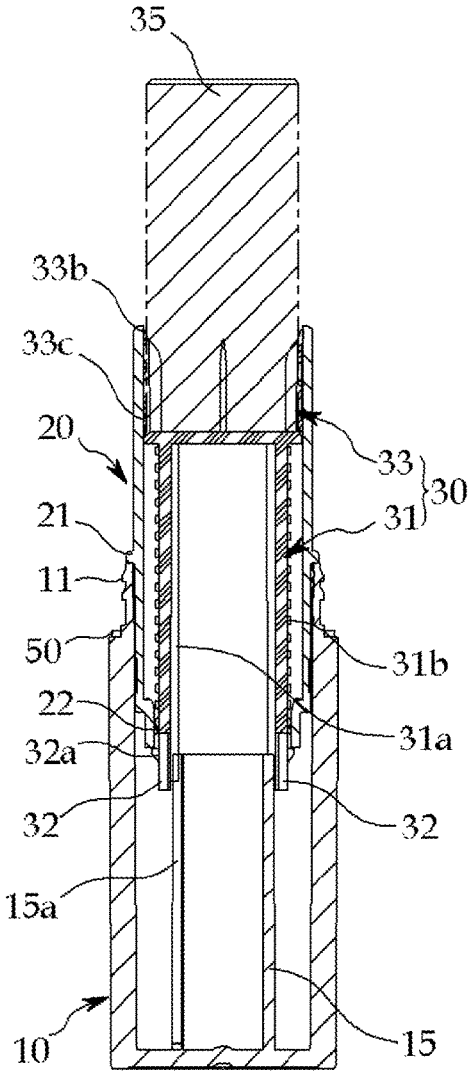

[Fig. 11]
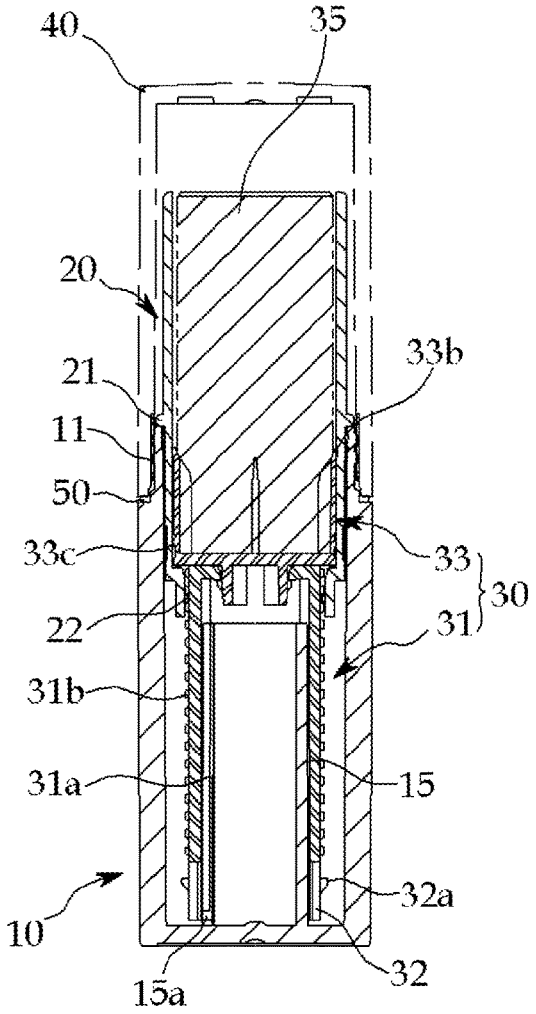
[Fig. 12]
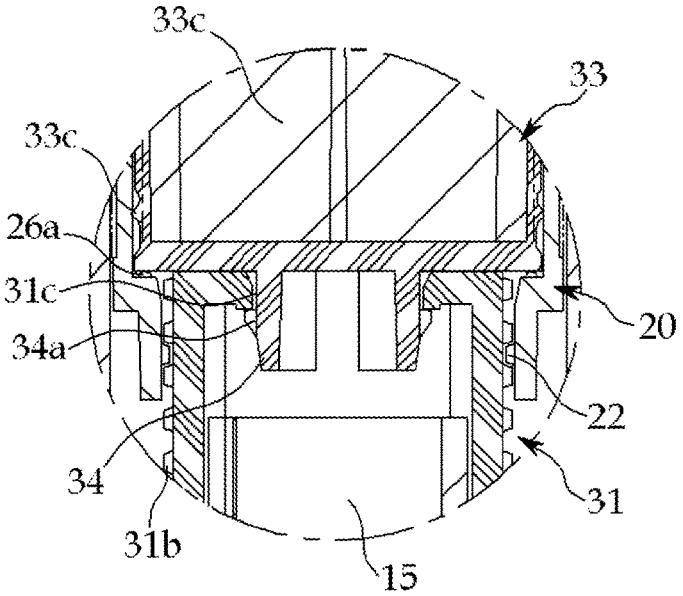

[Fig. 13]
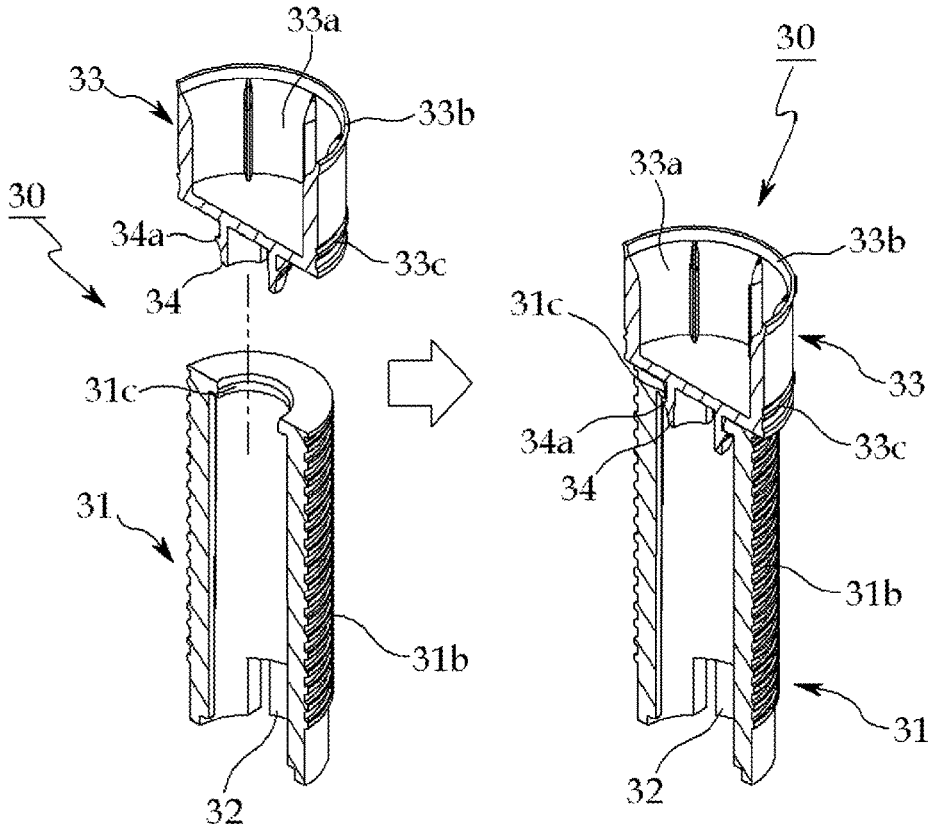
[Fig. 14]
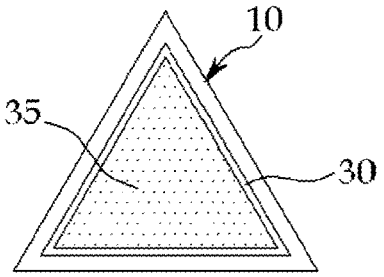
[Fig. 15]
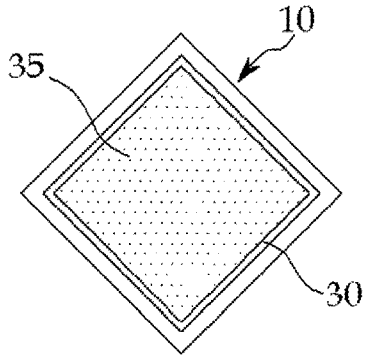

[Fig. 16]
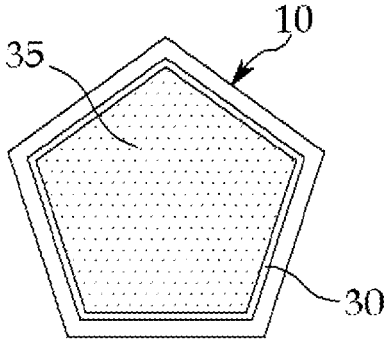
[Fig. 17]
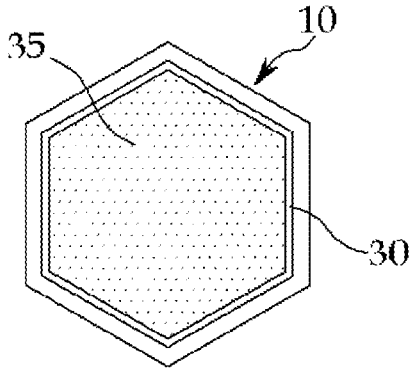

STICK TYPE COSMETIC CASE HAVING SCREW STRUCTURE

TECHNICAL FIELD

The present invention relates to a stick type cosmetic case having a screw structure for pushing out stick type makeup and, more particularly, a stick type cosmetic case having a screw structure that minimizes the number of processes of combining the parts of the case, simplifies the assembly structure, and allows for fine control of makeup by operating the case in a screw type.

BACKGROUND ART

In general, stick type makeup, for example, makeup formed in the shape of a stick such as lipstick and foundation is usually contained in a cosmetic container and configured to be pushed out for use.

Various shapes of stick type cosmetic cases have been proposed and Korean Utility Model No. 20-0471791 (Patent Document 2) discloses an example of such a cosmetic case, which includes: an outer case; a screw-shaped tube that has a spiral groove and is disposed in the outer case; a rotary tube that has a vertical guide hole and is disposed in the screw-shaped tube; a lipstick holder that has a guide projection inserted in the spiral groove of the screw-shaped tube and the guide hole of the rotary tube and is disposed in the rotary tube; and a top cap, in which when the rotary tube is rotated, the lipstick holder is guided to spirally vertically move so that lipstick is vertically moved into/out of the outer case.

The stick type cosmetic container of the related art is composed of several parts, that is, it has a complicated structure composed of at least five or more parts including the outer case, the screw-shaped tube, the rotary tube, the lipstick holder, and the top cap, so there was a problem that assembly was not easy and the manufacturing cost was high.

Further, according to the stick type cosmetic case of the related art, when the rotary tube is rotated, the guide projection is spirally guided and rapidly moved up or down by the spiral guide mechanism composed of the spiral groove of the screw-shaped tube, the vertical guide hole of the rotary tube, and the guide projection of the lipstick holder, so it is difficult to operate the case, and particularly, it is difficult to finely put in/out the makeup.

Further, the top cap is thread-fastened to the upper portion of the outer case to hermetically seal the stick type cosmetic case of the related art, that is, a sealing member is disposed on the outer side of the upper portion of the outer case or on the inside of the top cap to hermetically combine them, but the sealing member is twisted in contact with the outer side and the inner side when the top cap is tightened, so the contact force is not maximized and the makeup may spoil. Further, the sealing is more insufficient for foundation or wet makeup that undergoes a decompression test, so the reliability of products is deteriorated.

In addition, when a user opens the top cap of the stick type cosmetic case of the related art to use it, external air flows into the case and remains in contact with the makeup when the top cap is closed, so it causes the makeup to spoil.

RELATED ART DOCUMENTS (Patent Document 1) Korean Utility Model Publication No. 20-2015-0004424

(Patent Document 2) Korean Utility Model No. 20-0471791

(Patent Document 3) Korean Patent No. 10-0902274

DISCLOSURE OF INVENTION

Technical Problem

The present invention has been made in an effort to solve the problems of the related art and an object of the present invention is to improve assembly efficiency and reduce the manufacturing cost by minimizing the process of assembling a case and simplifying the assembly structure, and to provide convenience in use by using a spiral structure to move makeup in/out and allow simple operation and fine adjustments.

Another object of the present invention is to minimize effusion of the indigenous components as well as the moisture or fragrance of makeup to the outside and minimize the possibility of spoiling due to contact with external air by ensuring high airtightness of a case.

Another object of the present invention is to allow makeup to be moved up/down through spiral rotation or without rotation, depending on a holder structure, and to provide makeup in various lateral cross-sections.

Solution to Problem

A stick type cosmetic case having a screw structure of the present invention includes: a bottom body having a thread and a coupling step around an outer side of an upper portion and an insertion tube vertically formed therein; a middle body rotatably inserted in the upper portion of the bottom body and having a spiral portion on an inner side of a lower portion; a holder having a screw tube, which has a lower portion inserted in an insertion tube in the bottom body and a threaded portion on an outer side to be spirally coupled to the spiral portion of the middle body, and a holding tube having a holding groove at an upper portion to insert stick type makeup therein; and a top cap thread-fastened to the thread of the bottom body to be opened and closed.

The screw tube and the holding tube of the holder may be separately formed, a coupling tube having an equiangular division structure and having a locking step on an outer side may protrude down from a bottom of the holding tube, and a coupling groove in which the locking step is inserted to prevent the coupling tube inserted in the screw tube from separating may be formed at an upper portion of the screw tube.

A locking step locked to the spiral portion of the middle body and a tension tab that is elastically bent inward when the screw tube is combined may be formed on an outer side of the lower portion of the screw tube of the holder.

At least one or more vertical guide grooves may be vertically formed on an outer side of the insertion tube of the bottom body and a vertical guide projection inserted and guided in the vertical guide groove may be formed on an inner side of the screw tube of the holder.

A sealing member may be disposed on a coupling step of the bottom body and is vertically pressed by a pressing surface formed at a lower end of the top cap so that the bottom body and the top cap are hermetically combined, and an expanding mouth gradually expanding outward to have a diameter larger than an inner diameter of the middle body may be formed at an upper end of the holding tube of the holder to ensure sealing by being elastically in close contact with an inner side of the middle body.

A support projection being in close contact with the inner side of the middle body may be formed on an outer side of a lower portion of the holding tube of the holder to prevent movement of the holder.

The sealing member may be integrally formed in a ring-shaped groove on the coupling step of the bottom body by insert-molding.

A partial contact surface may be further formed on the top of the sealing member so that a pressing surface of the top cap hermetically operates in linear contact with the sealing member, or prominences and depressions may be further formed on the top of the sealing member and the pressing surface of the top cap.

Advantageous Effects of Invention

According to the present invention, the stick type cosmetic case is composed of a bottom body, a middle body combined with the bottom body, a holder thread-fastened to the middle body to hold makeup in the upper portion thereof, and a top cap. Accordingly, it is possible to minimize the number of parts of the case and simplify the assembly structure, as compared with the related art, so it is possible to make assembly convenient and reduce the manufacturing cost, and it is also possible to simply and finely move up/down the makeup because the makeup is moved up/down by the screw structure, thereby providing user satisfaction.

Further, the case is hermetically formed by the sealing structures between the bottom body and the top cap and between the holder and the middle body, so it is possible to minimize effusion of the indigenous components as well as the moisture or fragrance of makeup to the outside and minimize the possibility of spoiling due to contact with external air, thereby further increasing reliability of the product.

Furthermore, as the holder is configured in an integral type or an assembly type, makeup can be moved up/down with or without spiral turning, so it is possible to make the horizontal cross-section of the makeup in polygonal shapes such as a triangle, a rectangle, and a pentagon or other various shapes, other than a circular shape.

BRIEF DESCRIPTION OF DRAWINGS

FIG. 1 is a perspective view showing the external appearance of a case according to the present invention.

FIG. 2 is a perspective view showing the case shown in FIG. 1, with a top cap open.

FIG. 3 is an exploded perspective view showing an embodiment of the present invention.

FIG. 4 is a perspective cross-sectional view showing main parts of FIG. 3.

FIG. 5 is cross-sectional view of the assembly of the parts shown in FIG. 3.

FIG. 6 is a plan cross-sectional view of the main parts of FIG. 5.

FIG. 7 is an enlarged cross-sectional view of the main parts of FIG. 5.

FIGS. 8 and 9 are enlarged cross-sectional views of main parts according to various embodiments of the sealing member shown in FIG. 5.

FIG. 10 is an assembly cross-sectional view showing use of the case shown in FIG. 5

FIG. 11 is an assembly cross-sectional view showing another embodiment of a case according to the present invention.

FIG. 12 is an enlarged view of main parts of FIG. 11.

FIG. 13 is a perspective view showing a holder assembly structure of FIG. 11.

FIGS. 14 to 17 are plan views showing various embodiments of the holder shown in FIG. 11.

DESCRIPTION OF THE REFERENCE NUMERALS IN THE DRAWINGS

10: Bottom body 11: Thread
12: Coupling step 13: Groove
15: Insertion tube 15*a:* Vertical guide groove
20: Middle body 22: Spiral portion
30: Holder 31: Screw tube
31*a:* Vertical guide projection
31*b:* Threaded portion
31*c:* Coupling groove 32: Tension tap
32*a:* Locking step 33: Holding tube
33*a:* Holding groove 33*b:* Expanding mouth
33*c:* Support projection 34: Coupling tube
34*a:* Locking step 35: Makeup
40: Top cap 41: Pressing surface
42, 52: Prominence and depression
50: Sealing member 51: Partial contact surface

Mode For The Invention

Hereinafter, exemplary embodiments of the present invention will be described in detail with reference to the accompanying drawings.

A stick type cosmetic case having a screw structure of the present invention is, as shown in FIGS. 1 to 7, composed of a bottom body 10, a middle body 20, a holder 30, and a top cap 40.

The bottom body 10 has a thread 11 and a coupling step 12 around the outer side of the upper portion and an insertion tube 15 therein, and at least one or more vertical guide grooves 15*a* are vertically formed on the outer side of the vertical tube.

A sealing member 50 is coupled to the coupling step 12 of the bottom body and a ring-shaped groove 13 is formed on the coupling step 12 so that the sealing member 50 is integrally formed by insert molding.

The lower portion of the middle body 20 is rotatably inserted in the upper portion of the bottom body 10 such that a locking step 21 at the center portion of the outer side is seated and supported on the top of the bottom body 10.

A spiral portion 22 is formed on the inner side of the lower portion of the middle body 20.

Further, the bottom body 10 and the middle body 20 are rotatably combined without separating by inserting a coupling projection 24 formed on the outer side of the lower portion of the middle body and having a semicircular cross-section into a coupling groove 14 formed on the inner side of the upper portion of the bottom body and having a semicircular cross-section.

The holder 30 has a screw tube 31, which has a vertical guide projection 31*a* inserted on the insertion tube 15 in the bottom body and vertically guided in the vertical guide groove 15*a* and a threaded portion 31*b* formed on the outer side to be spirally coupled to the spiral portion 22 of the middle body, and a holding tube 33 that has a holding groove 33*a* at the top to hold stick type makeup 35.

Further, an expanding mouth 33*b* that expands outward is formed at the top of the holding tube 33 of the holder so that the top has a diameter at least larger than the inner diameter of the middle body 20 to secure airtightness by being in elastically close contact with the inner side of the middle body 20.

The expanding mouth 33*b* prevents air from flowing into the middle body 20 not only when the top cap 40 is separated, but also after the parts are combined, so it is possible to prevent the makeup 50 from drying out by air flowing in the middle body.

Further, a support projection 33*c* being in close contact with the inner side of the middle body 20 is formed on the outer side of the lower portion of the holding tube 33 of the holder in order to function as a support that prevents movement of the holder. That is, when the holder 30 is moved up and down or the makeup 35 held by the holder is used, shaking or moving of the makeup is prevented.

A locking step 32*a* locked to the spiral portion 22 of the middle body and a tension tab 32 that is elastically bent inward when the screw tube is combined are formed on the outer side of the lower portion of the screw tube 31.

The locking step 32*a* on the tension tab has an inclined surface in the insertion direction of the holder and a horizontal surface in the separation direction of the holder.

Further, at least two or more protruding support ribs 33*d* that hold the makeup 35 to prevent the makeup 35 from idling are vertically formed on the inner side of the holding groove 33*a* of the holding tube.

The top cap 40 is thread-fastened to the thread 11 of the bottom body 10 to be opened and closed and has a pressing surface 41 formed at the lower end and vertically pressing the sealing member 50 on the coupling step 12 of the bottom body to hermetically couple the top cap and the bottom cap.

In particular, an inclined partial contact surface 51 may be further formed on the top of the sealing member 50, as shown in FIG. 8, for hermetic linear contact of the pressing surface 41.

Further, as shown in FIG. 9, prominences and depressions 42 and 52 may be further formed on the pressing surface 41 and the top of the sealing member 50, respectively, to prevent the top cap and the sealing member from sticking to each other by partially spacing them in contact with each other even though the top cap is coupled for a long period of time.

Further, the inner edge of the pressing surface 41, which is formed at the lower end of the top cap 40 to come in linear contact with the partial contact surface 51 of the sealing member 50, may be rounded.

The thickness of the sealing member 50 is an important factor for stably providing elastic restoring force, so the protruding thickness of the sealing member 50 may be within a range of 0.3 ~0.6 mm so that appropriate vertical pressing force can be applied when the top cap is thread-fastened.

Reference numeral '26*a*' indicates a seat projection formed on the support step, which is formed on the inner side of the middle body 20 and supports the holder 30 to limit the downward position of the holder 30 that is being inserted, to minimize friction with the holder.

Operation of the present invention having this configuration is described hereafter.

First, according to the present invention, the middle body 20 is inserted in the upper portion of the bottom body 10 such that the coupling projection 24 formed around the outer side of the lower portion of the middle body is inserted in the coupling groove 14 formed around the inner side of the upper portion of the bottom body and the locking step at the center portion of the outer side of the middle body is seated on the top of the bottom body 10.

The holder 30 with the makeup 35 thereon is inserted in the middle body 20.

That is, the screw tube 31 of the holder 30 is inserted in the middle body 20 such that the locking step 32*a* of the tension tap 32 formed on the outer side of the lower portion of the screw tube is elastically closed inward by the spiral portion 22 in the middle body and then opened to the initial position so that the holder 30 is not separated by the locking step 32*a*.

The vertical guide projection 31*a* of the holder is inserted in the vertical guide groove 15*a* formed on the insertion tube 15 of the bottom body 10.

In this state, when a user holds the middle body 20 and turns the bottom body 10, the holder 30 is moved down to be coupled by the screw structure formed by the spiral portion 22 of the middle body and the threaded portion 31*b* on the outer side of the screw tube 31 of the holder 30.

The bottom body 10, the middle body 20, and the holder 30 are simply assembled in this way.

When a user holds the bottom body 10 and turns the middle body 20 to move out the makeup 35 in the assembly, the holder 30 cannot be turned by the screw structure formed by the spiral portion 22 of the middle body and the threaded portion 31*b* on the outer side of the screw tube 31 of the holder 30, so the holder 30 is moved up.

That is, the vertical guide projection 31*a* of the holder 30 is moved up along the vertical guide groove 15*a* on the insertion tube 15 of the bottom body 10.

As described above, since the holder 30 is moved up by the screw structure (with small inclined angles) formed by the spiral portion 22 of the middle body and the threaded portion 31*b* on the outer side of the screw tube 31 of the holder when the middle body 20 is turned, the middle body 20 can be smoothly turned and simply operated. Further, it is possible to finely protrude the makeup 35 in accordance with the pitches of the threads.

Further, since the holding tube 33 of the holder has the support projection 33*c* on the outer side of the lower portion to be in close contact with the inner side of the middle body 20, the holder 30 is prevented from shaking, so the makeup 35 can be stably moved up and down. Further, the makeup 35 is also prevented from shaking when it is used, so it is easier for the user to apply the makeup as desired.

Furthermore, since the holding tube 33 of the holder is elastically and hermetically in close contact with the inner side of the middle body 20 by the expanding mouth 33*b* formed at the top of the holding tube 33 to expand outward, external air cannot flow into the case through the gap between the holding tube 33 of the holder and the middle body 20 while the makeup is used. Accordingly, as described below, it is possible to prevent contact between external air in the case and the makeup when carrying or keeping the case after using it.

According to the cosmetic case of the present invention, after using the makeup, the user retracts the makeup 35 back into the case and then thread-fasten the top cap 40 to the upper portion of the bottom cap 10 to keep the case.

In this state, the pressing surface 41 at the lower end of the top cap 40 vertically presses the top of the sealing member 50 insert-molded on the coupling step 12 at the upper portion of the bottom body 10, thereby hermetically coupling the top cap and the bottom body.

In particular, since the partial contact surface 51 is further formed on the top of the sealing member 50, the pressing surface 41 of the top cap is in linear contact with the partial contact surface 51, thereby further hermetically coupling the top cap and the bottom body.

As described above, strong hermetic coupling is secured by the sealing member 50 between the top cap 40 and the bottom body 10 and the expanding mouth 33*b* between the middle body 20 and the holder 30, so it is possible to minimize effusion of the indigenous components as well as the moisture or fragrance of the makeup to the outside while or after using the makeup. Further, it is possible to minimize the possibility of the makeup spoiling due to contact with external air.

Further, since the prominences and depressions 42 and 52 are formed on the pressing surface 41 of the top cap and the top of the sealing member 50 so that the pressing surface and the sealing member are partially spaced in contact with each other, the problem in the related art that they stick to each other is prevented even through the top cap is coupled for a long period of time, so it is possible to simply open and close the top cap.

On the other hand, the present invention can be implemented in another way, as shown in FIGS. 11 to 13, in which the holder 30 is not formed in an integral type, but a separable type, as compared with the previous embodiment.

That is, the screw tube 31 and the holding tube 33 of the holder 30 are separately formed, a coupling tube 34 having an equiangular division structure and having a locking step 34*a* on the outer side protrudes down from the bottom of the holding tube, and a coupling groove 31*c* in which the locking step 34*a* is inserted to prevent the coupling tube 34 snapped in the screw tube 31 from separating is formed at the upper portion of the screw tube 31.

This embodiment is assembled in the same way as the previous embodiment and the screw tube 31 and the holding tube 33 of the holder are combined. When a user holds the middle body 20 and turns the bottom body 10 to move the makeup 35 in/out, the screw tube 31 moves up/down while spirally turning on the threaded portion 22 of the middle body, but the holding tube 33 axially coupled to the top of the screw tube 31 is moved up/down with the screw tube 31 without spirally turning.

That is, the holding tube 33 at the upper portion of the holder is combined with the screw tube 31 at the lower portion not to separate from the coupling groove 31*c* by the coupling tube 34, so when the screw tube 31 is spirally turned, the holding tube 33 is moved up/down without spirally turning.

The expanding mouth 33*b* at the upper end of the holding tube 33 of the holder is elastically in close contact with the inner side of the middle body 20 and the support projection 33*c* on the outer side of the lower portion is in close contact with the inner side of the middle body 20, so the holding tube 33 is uniformly moved up/down without spirally turning in the middle body 20.

As the holding tube 33 is moved up/down without turning, the makeup 35 seated in the holding groove 33*a* of the holding tube is also moved up/down without turning, so the makeup 35 can be simply moved up/down in use.

Since the makeup 35 is moved up/down without turning, it can be moved up/down in use even if the horizontal cross-section of the holder 30 is formed in the shape of polygons such as a triangle, a rectangle, and a pentagon and other various shapes, as shown in FIGS. 14 to 17, in addition to the simple circular shape, so it is possible to make various shapes of products.

Therefore, according to the present invention, since the case is composed of four pieces of a bottom body, a middle body, a holder, and a top cap, it is possible to minimize the number of parts of the case and simplify the assembly structure, as compared with the related art, so it is possible to make assembly convenient and reduce the manufacturing cost, and it is also possible to simply and finely move up/down the makeup because the makeup is moved up/down by the screw structure. Further, sealing is simply achieved between the bottom body and the top cap and between the middle body and the holder and is maximized, as compared with the related art, so it is possible to prevent the makeup from spoiling and maintain a high quality of the makeup. Furthermore, as the holder is configured in an integral type or an assembly type, makeup can be moved up/down with or without spiral turning, so it is possible to make the horizontal cross-section of the makeup in polygonal shapes such as a triangle, a rectangle, and a pentagon or other various shapes, other than a circular shape.

Although the present invention was described above with reference to the drawings, it should be understood that the present invention is not limited thereto and may be changed and modified without departing from claims.

The invention claimed is:

1. A stick type cosmetic case having a screw structure, the case comprising:

a bottom body (10) having a thread (11) and a coupling step (12) around an outer side of an upper portion and an insertion tube (15) vertically formed therein;

a middle body (20) rotatably inserted in the upper portion of the bottom body (10) and having a spiral portion (22) on an inner side of a lower portion;

a holder (30) having a screw tube (31), which has a lower portion inserted on said insertion tube (15) in the bottom body (10) and a threaded portion (31*b*) on an outer side to be spirally coupled to the spiral portion (22) of the middle body, and a holding tube (33) having a holding groove (33*a*) at an upper portion to insert stick type makeup (35) therein; and a top cap (40) thread-fastened to the thread (11) of the bottom body (10) to be opened and closed.

2. The stick type cosmetic case of claim 1, wherein the screw tube (31) and the holding tube (33) of the holder (30) are separately formed, a coupling tube (34) having an equiangular division structure and having a locking step (34*a*) on an outer side protrudes down from a bottom of the holding tube, and a coupling groove (31*c*) in which the locking step (34*a*) is inserted to prevent the coupling tube (34) inserted in the screw tube (31) from separating is formed at an upper portion of the screw tube (31).

3. The stick type cosmetic case of claim 2, wherein a locking step (32*a*) locked to the spiral portion (22) of the middle body and a tension tab (32) that is elastically bent inward when the screw tube is combined with the middle portion are formed on an outer side of the lower portion of the screw tube (31) of the holder (30).

4. The stick type cosmetic case of claim 2, wherein at least one or more vertical guide grooves (15*a*) are vertically formed on an outer side of the insertion tube of the bottom body (10) and a vertical guide projection (31*a*) inserted and guided in the vertical guide groove is formed on an inner side of the screw tube (31) of the holder.

5. The stick type cosmetic case of claim 2, wherein a sealing member (50) is disposed on a coupling step (12) of the bottom body (10) and is vertically pressed by a pressing surface (41) formed at a lower end of the top cap (40) so that the bottom body and the top cap are hermetically combined, and wherein an expanding mouth (33*b*) gradually expanding outward to have a diameter larger than an inner diameter of the middle body (20) is formed at an upper end of the holding tube (33) of the holder to ensure sealing by being elastically in close contact with an inner side of the middle body.

6. The stick type cosmetic case of claim 5, wherein a support projection (33*c*) being in close contact with the inner side of the middle body (20) is formed on an outer side of a lower portion of the holding tube (33) of the holder to prevent movement of the holder.

7. The stick type cosmetic case of claim 5, wherein the sealing member (50) is integrally formed in a ring-shaped groove (13) on the coupling step (12) of the bottom body by insert-molding.

8. The stick type cosmetic case of claim 5, wherein a partial contact surface (51) is further formed on a top of the sealing member (50) so that the pressing surface (41) of the top cap hermetically operates in linear contact with the sealing member.

9. The stick type cosmetic case of claim 5, wherein prominences and depressions (42 and 52) are further formed on the top of the sealing member (50) and the pressing surface (41) of the top cap for hermetic linear close contact.

10. The stick type cosmetic case of claim 1, wherein a locking step (32*a*) locked to the spiral portion (22) of the middle body and a tension tab (32) that is elastically bent inward when the screw tube is combined with the middle portion are formed on an outer side of the lower portion of the screw tube (31) of the holder (30).

11. The stick type cosmetic case of claim 1, wherein at least one or more vertical guide grooves (15*a*) are vertically formed on an outer side of the insertion tube of the bottom body (10) and a vertical guide projection (31*a*) inserted and guided in the vertical guide groove is formed on an inner side of the screw tube (31) of the holder.

12. The stick type cosmetic case of claim 1, wherein a sealing member (50) is disposed on a coupling step (12) of the bottom body (10) and is vertically pressed by a pressing surface (41) formed at a lower end of the top cap (40) so that the bottom body and the top cap are hermetically combined, and wherein an expanding mouth (33*b*) gradually expanding outward to have a diameter larger than an inner diameter of the middle body (20) is formed at an upper end of the holding tube (33) of the holder to ensure sealing by being elastically in close contact with an inner side of the middle body.

* * * * *